US008436267B2

(12) United States Patent
Staas et al.

(10) Patent No.: US 8,436,267 B2
(45) Date of Patent: May 7, 2013

(54) SWITCH ASSEMBLY FOR A POWER TOOL

(75) Inventors: Ernst Staas, Limburg (DE); Ralf Bernhart, Idestein (DE); Michael Stirm, Oberursel (DE); Achim Buchholz, Limburg (DE)

(73) Assignee: Black & Decker Inc., Newark, DE (US)

( * ) Notice: Subject to any disclaimer, the term of this patent is extended or adjusted under 35 U.S.C. 154(b) by 416 days.

(21) Appl. No.: 12/702,739

(22) Filed: Feb. 9, 2010

(65) Prior Publication Data

US 2010/0200380 A1 Aug. 12, 2010

(30) Foreign Application Priority Data

Feb. 12, 2009 (GB) ..... 0902315.1

(51) Int. Cl.
*H01H 13/62* (2006.01)

(52) U.S. Cl.
USPC ..... 200/565

(58) Field of Classification Search ..... 200/293, 200/293.1, 295, 565, 566, 336
See application file for complete search history.

(56) References Cited

U.S. PATENT DOCUMENTS

| | | | | |
|---|---|---|---|---|
| 3,511,956 | A * | 5/1970 | Fields | 200/565 |
| 3,834,468 | A | 9/1974 | Hettich et al. | |
| 4,509,864 | A * | 4/1985 | Oellig et al. | 200/38 D |
| 5,565,719 | A | 10/1996 | Kuhlmann | |
| 5,680,927 | A * | 10/1997 | Thornton | 200/565 |
| 7,034,234 | B1 * | 4/2006 | Brillhart | 200/302.1 |
| 2010/0018734 | A1 * | 1/2010 | Frauhammer et al. | 200/332 |

FOREIGN PATENT DOCUMENTS

| | | |
|---|---|---|
| DE | 1278860 | 9/1968 |
| DE | 3213672 | 10/1983 |
| FR | 2376602 | 7/1978 |
| FR | 2548405 | 1/1985 |

* cited by examiner

*Primary Examiner* — Felix O Figueroa
(74) *Attorney, Agent, or Firm* — Kofi Schulterbrandt; Scott B. Markow; Adan Ayala

(57) ABSTRACT

A switch assembly for a power tool including a switch member and a fixing part. The switch member including a finger grip part, a retaining part for retaining the switch member on a power tool, and an opening extending at least partially through the switch member, the retaining part arranged to project laterally with respect to an axis of the opening. The fixing part is arranged to be located in the opening. The switch assembly is arranged such that when the fixing part is at a first location in the opening, the retaining part adopts a retention configuration in which it projects laterally to a predetermined extent. When the fixing part is removed or at a second location in the opening, the retaining part adopts an insertion configuration in which it does not project laterally or projects less than the predetermined extent.

17 Claims, 4 Drawing Sheets

SWITCH ASSEMBLY FOR A POWER TOOL

RELATED APPLICATIONS

This application claims priority under 35 U.S.C. §119 to U.K. Application 0902315.1 filed on Feb. 12, 2010, which is incorporated herein by reference.

SUMMARY

The present invention relates to a switch assembly for a power tool, to a power tool housing assembly including the switch assembly, and to a power tool including the housing assembly.

The power tool according to the invention may be substantially any type of power tool, for example a drill (e.g. a hammer drill or a percussion drill), a rotary hammer, a sander, a screwdriver, a saw, a planer, a router, a nailer, etc. However, the invention will be described with reference to a hammer drill or rotary hammer. The switch assembly of the invention may be used for substantially any purpose required for a power tool, for example for switching between speeds and/or gears and/or operating modes (e.g. drilling and/or hammer action) of the power tool.

The following patent publications each disclose power tools with switch assemblies: U.S. Pat. Nos. 3,834,468; 3,955,628; 4,158,970; 5,992,257; DE 102005041448 A1 and DE 3213672.

The present invention seeks to provide, among other things, a switch assembly for a power tool which can be securely attached in place on the power tool from the exterior of a housing of the tool. This has an advantage that an aperture in the housing, in which the switch assembly is arranged to be received, may be used during the assembly of the power tool to supply lubricating oil or grease to a mechanism of the tool located in the housing. Once the oil or grease has been supplied to the interior of the housing, the switch assembly can be fitted into place, thus closing the aperture.

A first aspect of the present invention provides a switch assembly for a power tool, comprising: (i) a switch member comprising a finger grip part, a retaining part for retaining the switch member on a power tool, and an opening extending at least partially through the switch member, the retaining part arranged to project laterally with respect to an axis of the opening; and (ii) a fixing part arranged to be located in the opening; the switch assembly arranged such that when the fixing part is at a first location in the opening, the retaining part adopts a retention configuration in which it projects laterally to a predetermined extent, and when the fixing part is removed or at a second location in the opening, the retaining part adopts an insertion configuration in which it does not project laterally or projects less than the predetermined extent.

In one embodiment, the first location is one at which the fixing part is inserted into the opening substantially to its maximum extent. The second location preferably is one at which the fixing part is partially removed from the opening. The retaining part may be arranged to flex between the retention and insertion configurations.

Advantageously, the retaining part may comprise one or more protrusions arranged to project laterally with respect to the axis of the opening. Preferably, when the retaining part is in its retention configuration, the one or more protrusions project laterally to the predetermined extent. When the retaining part is in its insertion configuration, the one or more protrusions preferably do not project laterally or project less than the predetermined extent.

In embodiments of the invention, the fixing part includes a screw thread by which it may be located in the opening. The opening preferably includes a screw thread by which the fixing part may be located in the opening.

The switch member opening preferably extends through the finger grip part and at least partially through the retaining part. A cover part may be included, to close the opening at the finger grip part, thereby covering the fixing part in use.

A second aspect of the invention provides a housing assembly for a power tool, comprising: (i) a housing having an aperture extending therethrough; and (ii) a switch assembly according to the first aspect of the invention, the switch member arranged to extend through the aperture from the exterior of the housing, such that the retaining part is situated adjacent to an interior surface of the housing; wherein the fixing part is arranged to fix the retaining part in the retention configuration, thereby trapping at least a portion of the retaining part behind the interior surface of the housing and thus preventing the switch member from being removed from the housing.

A third aspect of the invention provides a housing assembly for a power tool, comprising: (i) a housing having an aperture extending therethrough; (ii) a manually operable switch member including a retaining part, the manually operable switch member arranged to extend through the aperture from the exterior of the housing, such that the retaining part is situated adjacent to an interior surface of the housing; and (iii) a fixing part arranged to extend at least partially through the switch member; wherein the fixing part is arranged to fix the retaining part in a retention configuration in which it is trapped behind the interior surface of the housing, thereby preventing the switch member from being removed from the housing.

In an implementation, the housing assembly is arranged such that, when the retaining part is in the insertion configuration, the switch member may be inserted into the aperture from the exterior of the housing, such that the retaining part passes through the aperture and is then situated adjacent to an interior surface of the housing.

The switch member preferably is arranged to rotate in the aperture in the housing in use, to perform its switching function. The switch assembly may include a detent button resiliently movable with respect to the switch member, for releasably latching the switch member in any one of a plurality of rotational orientations in use.

A fourth aspect of the invention provides a power tool, including a motor and a housing according to the second or third aspect of the invention.

It is to be understood that any feature of any aspect of the invention may be a feature of any other aspect of the invention.

As indicated above, the switch assembly preferably is for switching between speeds and/or gears and/or operating modes (e.g. drilling and/or hammer action) of the power tool. The power tool preferably is a hammer drill or rotary hammer, but it may be substantially any power tool.

DETAILED DESCRIPTION OF THE DRAWINGS

Figure 1:
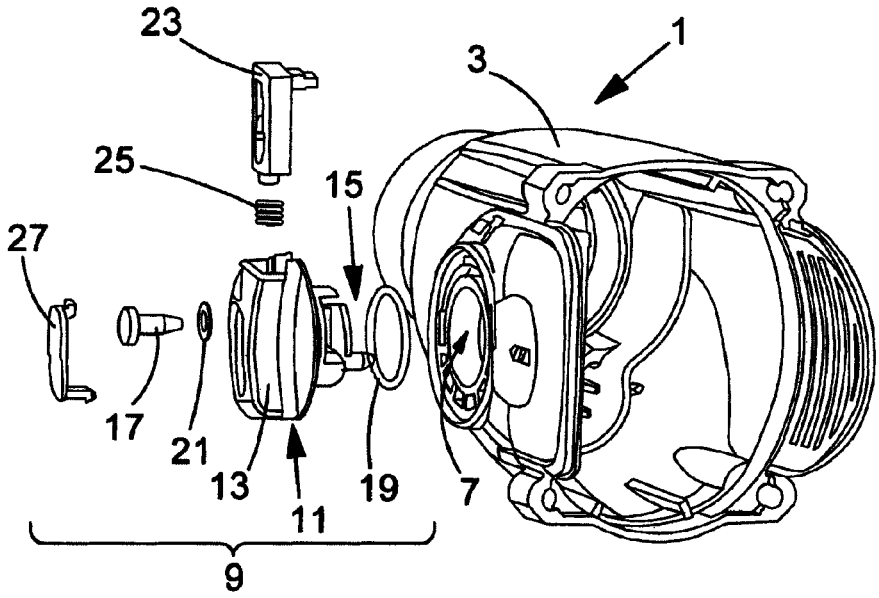
FIG. 1 is an exploded diagram of a housing assembly of a power tool according to the invention, including a switch assembly according to the invention.
Figure 2:
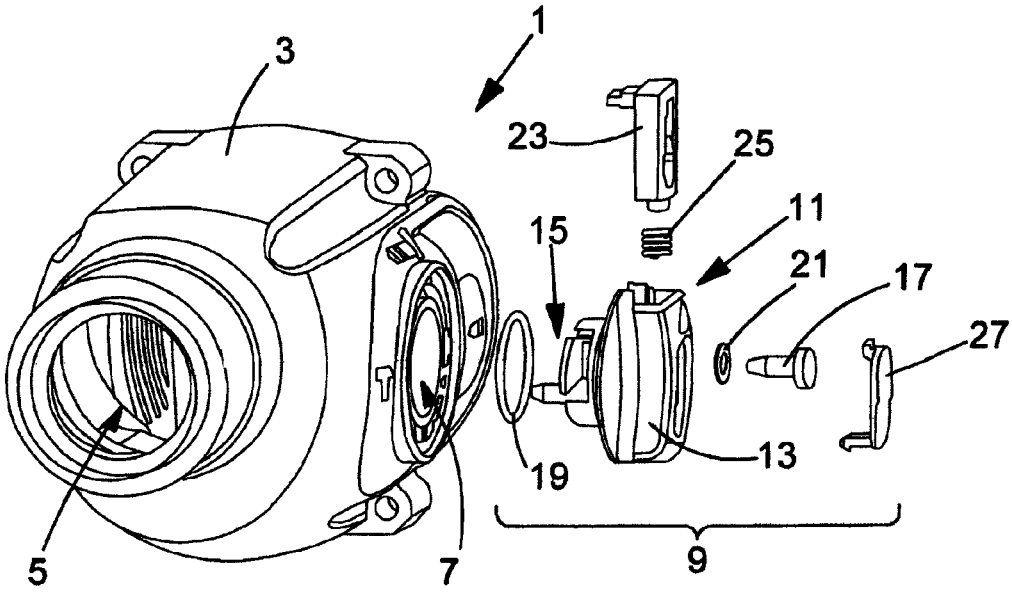
FIG. 2 is the exploded diagram of FIG. 1, from a different perspective.

FIGS. 1 and 2 show two exploded views of a power tool housing assembly 1 according to the invention. The illustrated housing assembly 1 is a front housing assembly for a hammer drill, comprises a housing 3 having a front opening 5 for an output spindle of the drill, and a side aperture 7 for receiving a switch assembly 9 according to the invention. The switch assembly 9 comprises a manually operable switch member 11 comprising a finger grip part 13 and a retaining part 15. The manually operable switch member 11 is arranged to be inserted through the aperture 7 from the exterior of the housing 3, such that the retaining part 15 is situated adjacent to an interior surface of the housing.

The switch assembly 9 includes a fixing part 17 arranged to extend at least partially through the switch member 11, in an opening 37 (see FIG. 4) which extends through the switch member. The fixing part 17 is arranged to fix the retaining part 15 in a retention configuration in which it is trapped behind the interior surface of the housing 3, thereby preventing the switch member 11 from being removed from the housing. The switch assembly also includes first and second seals 19 and 21 to help retain lubricating oil or grease inside the housing. The switch assembly 9 further includes a detent button 23 received in the switch member and resiliently movable with respect to the switch member by means of a spring 25 (or another resilient member). The detent button 23 is arranged to engage with a profile on the exterior of the housing 3, to releasably latch the switch member 11 in any one of a plurality of rotational orientations in use, each orientation corresponding to a particular switch position. Finally, a cover part 27 is also included, for closing the opening in the switch member 11 at the finger grip part 13, thereby covering the fixing part 17 in use.

Figure 3:
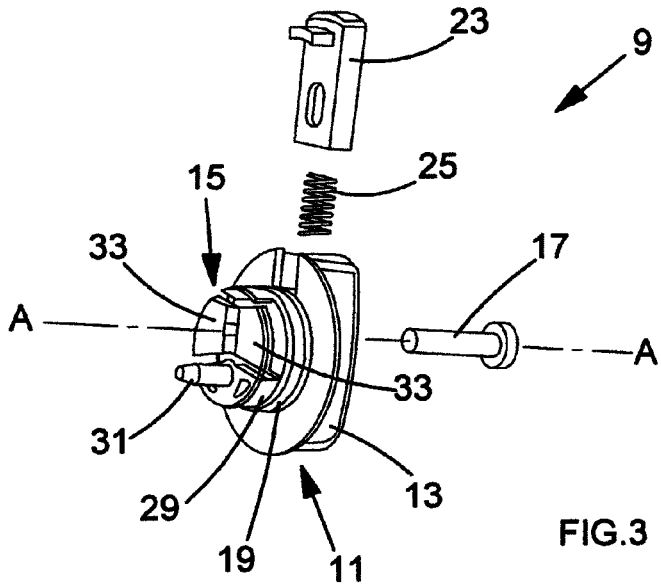
FIG. 3 shows an embodiment of a switch assembly according to the invention, similar to that shown in FIGS. 1 and 2.
Figure 4A:
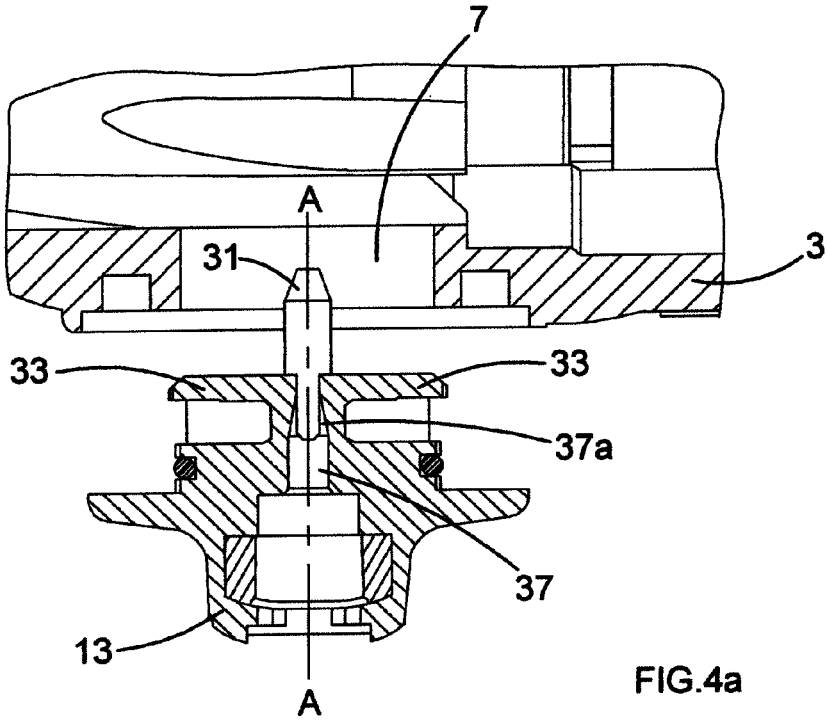
FIG. 4 comprises four cross-sectional views of the switch assembly of FIGS. 1 and 2, showing the installation of the switch assembly on the housing of the power tool.
Figure 4B:
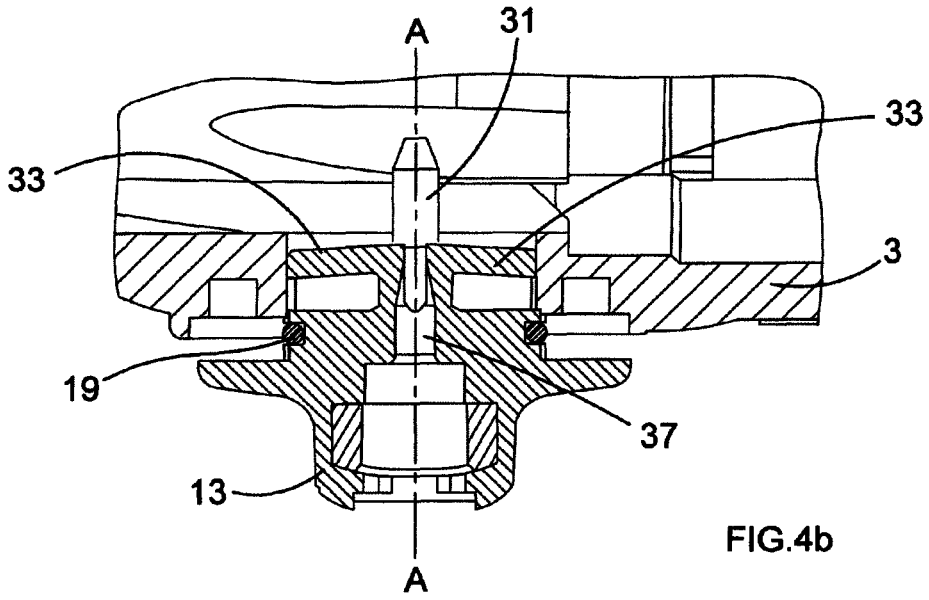
Figure 4C:
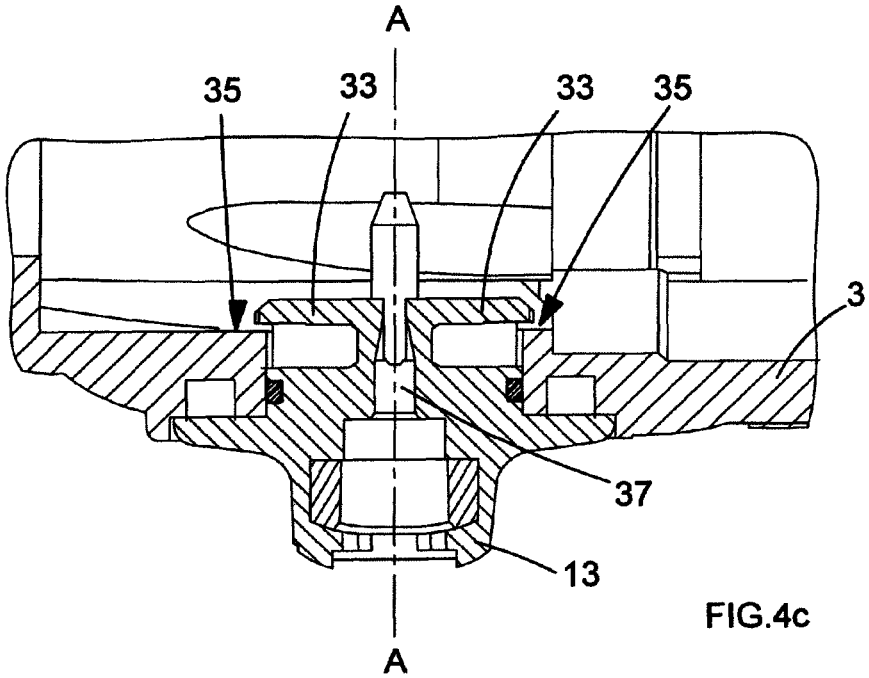
Figure 4D:
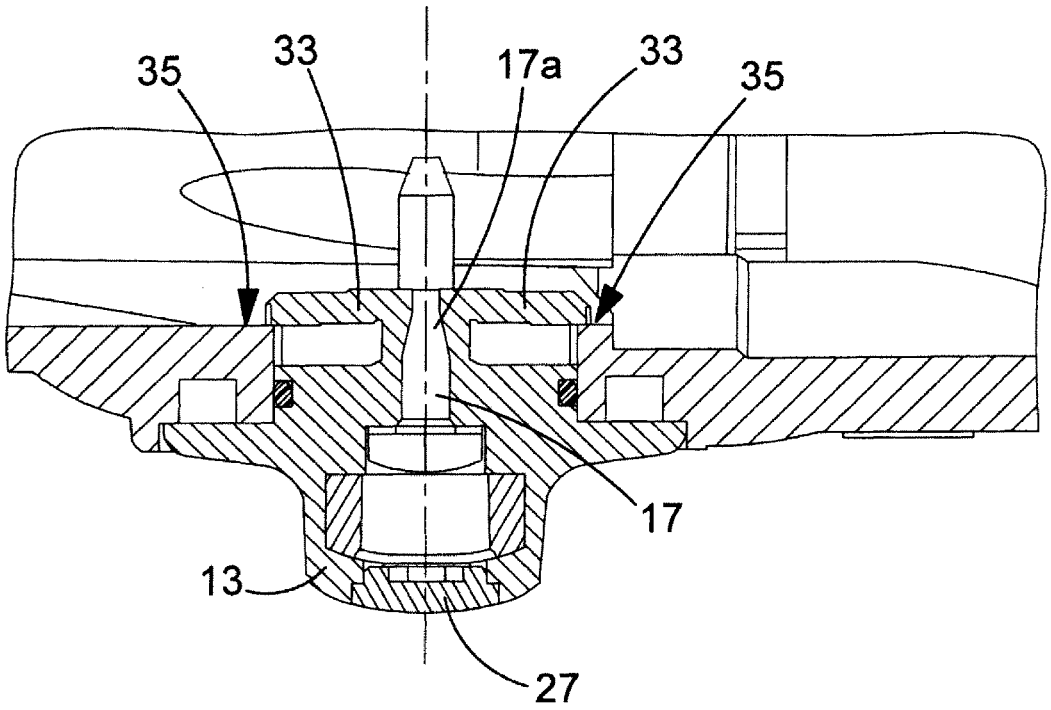

FIG. 3 shows an embodiment of a switch assembly 9 according to the invention, similar to that shown in FIGS. 1 and 2. An opening 37 (see FIG. 4) having an axis A-A extends through the switch member 11. The retaining part 15 is attached to a generally cylindrical portion 29 of the switch member 11, which extends from the finger grip part 13. The generally cylindrical portion 29 is arranged to be received in the aperture 7 in the power tool housing 3, such that the switch assembly may be manually rotated in the aperture to carry out its switching operations. The generally cylindrical portion 29 also carries the first seal 19, which is arranged to provide sealing between the switch member 11 and the housing 3. The generally cylindrical portion 29 also carries an actuation pin 31 which is mounted eccentrically with respect to the rotational axis (not shown) of the switch member and extends inside the power tool housing 3. The actuation pin 31 is arranged to engage part of a mechanism of the power tool, to carry out a switching function by its movement when the switch member 11 is rotated in use. For example, movement of the actuation pin 31 may cause the operating mode of a hammer drill (i.e. drilling and/or hammer action) to be selected. This is conventional and understood by the skilled person. Other conventional switching operations may be carried out by the switch member 11.

The retaining part 15 comprises a pair of protrusions 33 which project laterally with respect to the axis A-A of the opening 37 in the switch member 11. The protrusions 33 are flexibly attached to the generally cylindrical portion 29 of the switch member, such that they can flex laterally inwardly and outwardly. The protrusions 33 are arranged such that they can pass through the aperture 7 in the power tool housing 3, either without flexing, or by flexing inwardly, until they are adjacent to an interior surface of the housing. If the protrusions 33 need to flex inwardly in order to pass through the aperture 7, then when they are through the aperture they may flex outwardly to their rest position, due to resilience. Once the protrusions 33 are adjacent to the interior surface of the housing 3, the switch member 11 may be rotationally secured to the housing by fully inserting the fixing part 17 into the opening in the switch member, through the finger grip part 13 which is located outside the housing 3. The fixing part 17 and the opening preferably are screw threaded. When the fixing part 17 is fully inserted into the opening 37 in the switch member 11, it prevents the protrusions 33 from flexing laterally inwardly, and thus prevents the switch member from being removed from the housing 3. Thus, the fixing part 17 prevents the protrusions 33 from being released from a trapped position on the interior surface of the housing 3. The trapped position of the protrusions 33 may be due to a resiliently flexible attachment of the protrusions to the generally cylindrical portion 29, or it may be caused by the fixing part 17 forcing the protrusions laterally outwardly, or it may be a combination of these two effects.

FIG. 4 comprises four cross-sectional views ((a) to (d)) of the switch assembly 9 of FIGS. 1 and 2, showing the installation of the switch assembly on the housing 3 of the power tool. In FIG. 4(*a*), the switch assembly 9 is almost entirely outside the housing 3, just with part of the actuation pin 31 extending into the aperture 7. In FIG. 4(*b*), the switch assembly 9 is partially inserted into the aperture, and the protrusions 33 have needed to flex laterally inwardly in order to pass through the aperture 7. In FIG. 4(*c*), the switch assembly 9 has been fully inserted into the aperture 7, and the protrusions 33 have flexed laterally outwardly to their rest positions, trapped adjacent to an interior surface 35 of the housing. In FIG. 4(*d*), the fixing part 17 has been fully inserted into the opening 37 in the switch member 11, thereby flexing the protrusions 33 slightly further outwards laterally, and preventing them from flexing laterally inwardly. A front part 17*a* of the fixing part 17 is frusto-conical, and is arranged to act like a wedge with a frusto-conical rear part 37*a* of the opening 37, to force the protrusions 33 slightly further apart. Finally, the cover part 27 has been attached to the switch member 11 to close the opening 37 and to cover the fixing part 17. The switch member 11 is thus rotationally attached to the housing 3 in the aperture 7.

It will be understood that the above description and the drawings are of a particular example of the invention, but that other examples of the invention are included in the scope of the claims.

What is claimed is:

1. A switch assembly in a power tool, the power tool including a housing, the housing including an aperture for receiving the assembly and the power tool further including a first power tool purpose and a second power tool purpose, the switching assembly comprising: a switch member comprising a finger grip part, a retaining part for retaining the switch member on the power tool, and an opening extending at least partially through the switch member, the retaining part arranged to project laterally with respect to an axis of the opening; and a fixing part arranged to be located in the opening; the switch assembly arranged such that when the fixing part is at a first location in the opening, the retaining part adopts a retention configuration in which it projects laterally to a predetermined extent, and when the fixing part is removed or at a second location in the opening, the retaining part adopts an insertion configuration in which the retaining part does not project laterally or projects less than the predetermined extent, wherein the assembly further includes a seal between the switch member and the aperture to help retaining lubricating oil in the housing and wherein the switching member switches the power tool between the first and second power tool purposes.

2. A switch assembly according to claim 1, in which the retaining part is arranged to flex between the retention and insertion configurations.

3. A switch assembly according to claim 1, in which the retaining part comprises one or more protrusions arranged to project laterally with respect to the axis of the opening.

4. A switch assembly according to claim 3, in which, when the retaining part is in its retention configuration, the one or more protrusions project laterally to the predetermined extent.

5. A switch assembly according to claim 3, in which, when the retaining part is in its insertion configuration, the one or more protrusions do not project laterally or project less than the predetermined extent.

6. A switch assembly according to claim 1, in which the fixing part and the opening include screw threads by which the fixing part may be located in the opening.

7. A switch assembly according to claim 1, in which the first location is one at which the fixing part is inserted into the opening substantially to a maximum extent.

8. A switch assembly according to claim 1, in which the second location is one at which the fixing part is partially removed from the opening.

9. A switch assembly according to claim 1, in which the opening extends through the finger grip part and at least partially through the retaining part.

10. A switch assembly according to claim 9, further comprising a cover part arranged to close the opening at the finger grip part, thereby covering the fixing part in use.

11. A switch assembly according to claim 1, further comprising a detent button resiliently movable with respect to the switch member, for releasably latching the switch member in any one of a plurality of rotational orientations in use.

12. A housing assembly in a power tool, the power tool further including a first power tool purpose and a second power tool purpose, the housing assembly comprising: (i) a housing having an aperture extending therethrough; and (ii) a switch assembly having (a) a switch member comprising a finger grip part, a retaining part for retaining the switch member on the power tool, and an opening extending at least partially through the switch member, the retaining part arranged to project laterally with respect to an axis of the opening; and (b) a fixing part arranged to be located in the opening; the switch assembly arranged such that when the fixing part is at a first location in the opening, the retaining part adopts a retention configuration in which the retaining part projects laterally to a predetermined extent, and when the fixing part is removed or at a second location in the opening, the retaining part adopts an insertion configuration in which the retaining part does not project laterally or projects less than the predetermined extent, the switch member arranged to extend through the aperture from an exterior of the housing, such that the retaining part is situated adjacent to an interior surface of the housing; wherein the fixing part is arranged to fix the retaining part in the retention configuration, thereby trapping at least a portion of the retaining part behind an interior surface of the housing and thus preventing the switch member from being removed from the housing, wherein the assembly further includes a seal between the switch member and the aperture to help retaining lubricating oil in the housing and wherein the switching member switches the power tool between the first and second power tool purposes.

13. A housing assembly according to claim 12, arranged such that, when the retaining part is in the insertion configuration, the switch member may be inserted into the aperture from the exterior of the housing, such that the retaining part passes through the aperture and is then situated adjacent to the interior surface of the housing.

14. A power tool, including a motor, and the housing assembly according to claim 12.

15. A power tool according to claim 14, in which the switch assembly is for switching between speeds and/or gears and/or operating modes of the power tool.

16. A housing assembly in a power tool, the power tool further including a first power tool purpose and a second power tool purpose, the housing assembly comprising: (i) a housing having an aperture extending therethrough; (ii) a manually operable switch member including a retaining part, the manually operable switch member arranged to extend through the aperture from an exterior of the housing, such that the retaining part is situated adjacent to an interior surface of the housing; and (iii) a fixing part arranged to extend at least partially through the switch member; wherein the fixing part is arranged to fix the retaining part in a retention configuration in which it is trapped behind the interior surface of the housing, thereby preventing the switch member from being removed from the housing, wherein the housing assembly further includes a seal between the switch member and the aperture to help retaining lubricating oil in the housing and wherein the switching member switches the power tool between the first and second power tool purposes.

17. A housing assembly according to claim 16, arranged such that, when the retaining part is not in the retention configuration, the switch member may be inserted into the aperture from the exterior of the housing, such that the retaining part passes through the aperture and is then situated adjacent to the interior surface of the housing.

* * * * *